United States Patent [19]

Schneider

[11] 4,149,642

[45] Apr. 17, 1979

[54] REFUSE COLLECTION WAGON

[76] Inventor: Willi Schneider, Westerwaldstrasse 28, Herbon, Fed. Rep. of Germany, 6348

[21] Appl. No.: 844,354

[22] Filed: Oct. 21, 1977

Related U.S. Application Data

[63] Continuation-in-part of Ser. No. 656,954, Feb. 10, 1976, abandoned.

[51] Int. Cl.[2] ..... B65F 3/28

[52] U.S. Cl. ..... 414/523; 414/528

[58] Field of Search ..... 214/503, 508–510, 214/519, 82, 83.3, 83.36, 83.22; 100/218, 229 A

[56] References Cited

U.S. PATENT DOCUMENTS

| | | | |
|---|---|---|---|
| 2,340,983 | 2/1944 | Pfeiffer et al. | 214/83.36 X |
| 2,771,203 | 11/1956 | Collins et al. | 214/519 |
| 3,051,298 | 8/1962 | Knight | 214/83.36 X |
| 3,280,994 | 10/1966 | Herpich et al. | 214/503 |
| 3,955,694 | 5/1976 | Herpich | 214/83.3 |

FOREIGN PATENT DOCUMENTS

| | | | |
|---|---|---|---|
| 1225435 | 8/1961 | Fed. Rep. of Germany | 214/519 |
| 1907053 | 2/1969 | Fed. Rep. of Germany | 214/503 |
| 1338449 | 12/1963 | France | 214/510 |

*Primary Examiner*—Albert J. Makay

*Attorney, Agent, or Firm*—Colton & Stone, Inc.

[57] ABSTRACT

A refuse compacting mechanism is provided in the container of a refuse wagon. The mechanism includes a series of bars transversely oriented on the floor of the container and a pusher mechanism at the rear of the container. Uncompacted refuse falls into the container rearwardly of the bars and is pushed toward and compacted against the rearmost bar by the pusher mechanism. As additional refuse is added and compacted, the previously compacted mass topples forwardly over the rearmost bar to be further compacted against the next bar. Preferrably, the bars are connected to endless chains and may be moved rearwardly in unison to aid in unloading compacted refuse from the container.

8 Claims, 8 Drawing Figures

REFUSE COLLECTION WAGON

This application is a continuation-in-part of my earlier filed, copending application Ser. No. 656,954, filed Feb. 10, 1976, now abandoned.

The invention relates to a refuse or trash collecting wagon having a chassis, a refuse container arranged on the chassis, a tail part hinged on the refuse container and containing a refuse filling opening, and refuse compactors arranged in the refuse container.

Domestic and industrial refuse is placed into refuse bins at the place of origin and the refuse bins are emptied into the refuse collecting wagons by the refuse workers. The refuse collecting wagons transport the refuse to the depot where it is dumped. A high degree of filling is a prerequisite for economic operation of a refuse collecting wagon. The refuse is only placed loosely into a refuse bin and is possibly only slightly compressed. Thus it can, and must, be compressed to a greater degree in the refuse container of the refuse collecting wagon. A large number of compactors are already known for this purpose. Some kinds of compactors are in the form of hydraulically operated rams, rotating worms, etc., and are arranged in the refuse container itself. The space taken up by these compactors reduces the space available for the transportation of refuse. It also has to be borne in mind that a refuse container containing compressed refuse is more difficult to empty than a container only filled with loose refuse. Thus, known refuse containers are frequently tipped up on their rear edges for emptying, their tail parts being elevated at the same time. Owing to the resultant displacement of the centre of gravity in the refuse container and due to the fact that the ground at a depot is frequently loose, the entire refuse collecting wagon sometimes topples over. In other known kinds of refuse compactors, hydraulically operated vanes are mounted in a depression at the filling opening. The vanes press the refuse into the refuse container from the rear. These refuse compactors do not take up any space in the refuse container itself, but their weight renders the refuse collecting wagon tail-heavy.

Proceeding from this, a feature of the invention is to provide a refuse wagon, having refuse compactors arranged in the refuse container, such that the refuse can be compressed up to a high degree in the refuse container and, nevertheless, can be discharged from the refuse container without tipping up the latter. At the same time, the refuse compactor should be designed preferably so that it takes up only a small amount of space in the refuse container.

In accordance with the invention, a refuse or trash collecting wagon comprises a chassis, a refuse container supported on the chassis and having a hinged tail part containing a refuse filling opening, and refuse compacting devices arranged in the refuse container, said devices including a plurality of spaced, transversely extending bars which are arranged in the refuse container above the bottom thereof, and which are commonly movable towards the tail part.

The refuse is pushed forwardly from the rear into the refuse container and over these bars by means of a pusher which is arranged in the tail of the refuse collecting wagon and which can be weaker and lighter than an arrangement which simultaneously compresses the refuse. When the first portions of the refuse strike against the rearmost rail, they accummulate against the bar and are compressed. A pile of compressed refuse is built up to a specific height. After it has reached a certain height, the pile of refuse is tipped forwardly over the bar and is pushed further forward in a compressed state by the refuse which is pressed forward from the rear. Upon reaching the second bar (viewed from the rear), the compressed refuse is again accumulated and further compressed. The refuse accumulating against this second bar forms a pile which is compressed to a greater extent than at the first bar, tilts forward and is pushed towards the third bar. This is repeated until the refuse abuts against the front wall of the refuse container.

The essential feature of this operation is that the refuse accummulates and is compressed at the so-called first bar at a short distance from the refuse pusher. This compression is repeated and increased along the entire forward movement of the refuse across the bottom of the refuse container. The refuse arrives at the front wall of the refuse container in an already greatly compressed state and is built up against the front wall at a gradient which corresponds to its composition and compression. In the known compactors arranged in the tail, the refuse is pushed forwardly along the entire bottom of the refuse container without resistance and is only compressed at the front wall of the refuse container by the refuse which is pushed forward from the rear. The effect of the refuse compactor arranged in the tail is lost over the length of the bottom of the refuse container. The refuse located between the front wall and the tail acts like a cushion and reduces the compressive forces. The refuse collecting wagon becomes tail-heavy.

The refuse is compressed up to a quarter or fifth of its original volume by means of the bars which, in accordance with the invention, are arranged to extend transversely. The refuse is thus compressed up to a specific gravity of 500 kg/m$^3$. These are extremely satisfactory, high values.

It is a feature of the invention that the refuse container can be readily emptied despite the high compression of the refuse contained therein. For this purpose, the transversely extending bars are moved in unison to the rear when the tail is swung up. They then act as scrapers and pull and push the dropping refuse to the rear and eject it from the refuse container. Practical operation has shown that, contrary to prevailing opinion, no bridges are formed across the bars, and the refuse is engaged by the bars only in the immediate region thereof and sticks to the container walls as a result of its own pressure and pressing against the container walls. With a high degree of compression, the gravity resulting from the high specific gravity of the refuse exceeds the lateral contact pressures and the refuse drops onto the bars. The refuse is continuously pushed out rearwardly by means of the bars. It is no longer necessary to swing up the refuse container.

It is obvious that the transversely extending bars take up only a small amount of space. Owing to the uniform compression of the refuse over the entire cross section of the refuse container, the refuse container is also emptied without displacing the centre of gravity. The refuse is also uniformly compressed over the entire length of the refuse container.

The rear axle is not loaded to a greater extent than the front axle, thus avoiding the risk that the entire refuse collecting wagon will tilt laterally when a rear wheel is driven onto soft ground. The overall efficiency and economy of the refuse collecting wagon is also increased owing to the fact that the front and rear axles are uniformly loaded.

In an advantageous development, the bars are secured to endless chains which are guided by way of guide rollers at the front and rear ends of the bottom of the refuse container. The guide rollers are mounted on shafts and one of the two shafts is driven.

For the purpose of driving one of the shafts, it may be connected to the power take-off shaft of the wagon by way of an intermediate transmission unit. Alternatively, a self-contained drive can be provided which has an hydraulic cylinder which drives the chain in one direction by way of a free wheel device.

The invention is further described, by way of example, with reference to the accompanying drawings, in which.

Figure 1:
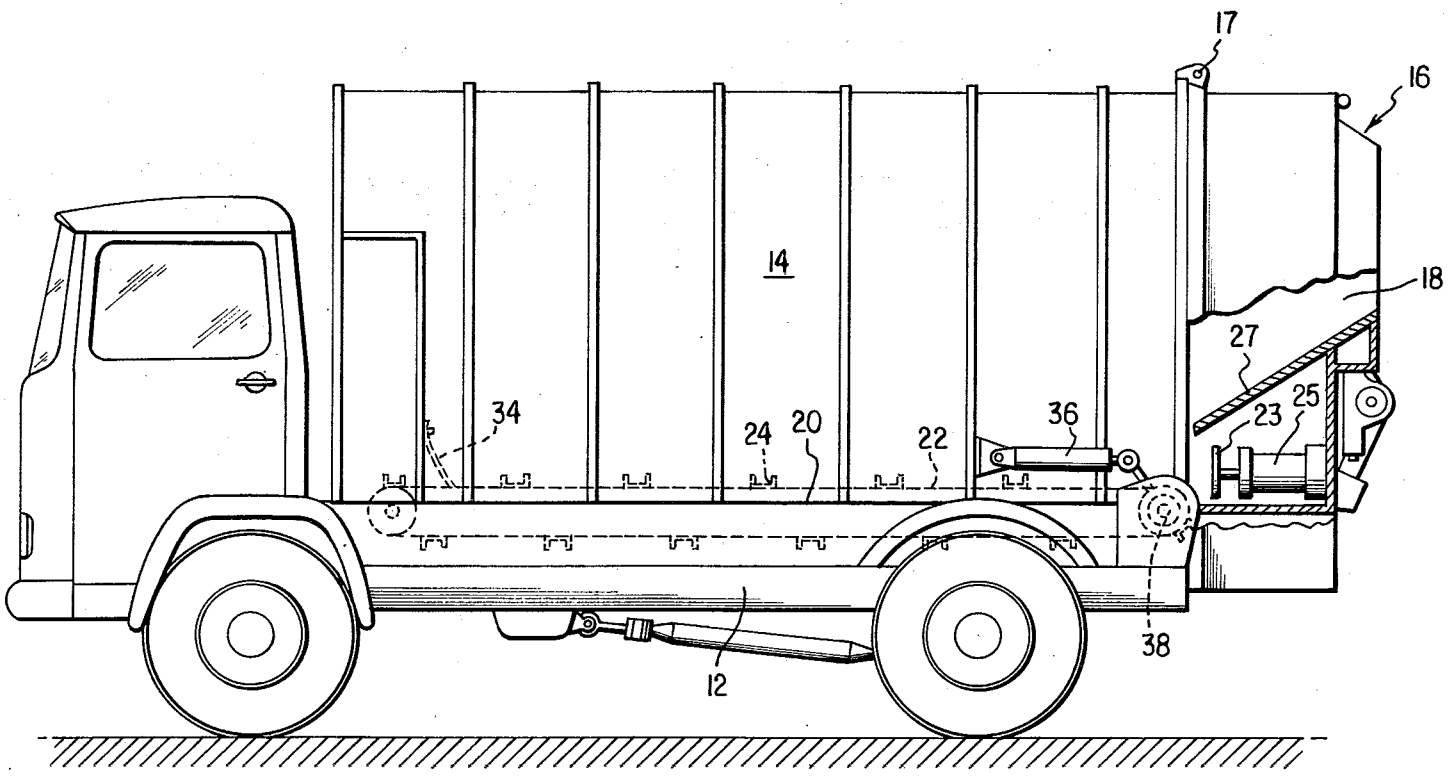
FIG. 1 is a side elevational view of a refuse collection wagon equipped with the compacting mechanism of the present invention.
Figure 2:
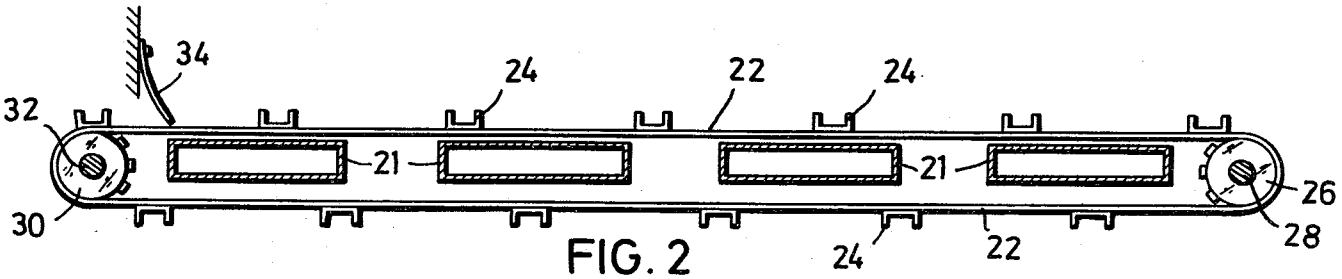
FIG. 2 is a fragmentary side elevational view of the floor of the refuse container of the wagon of FIG. 1.
Figure 3:
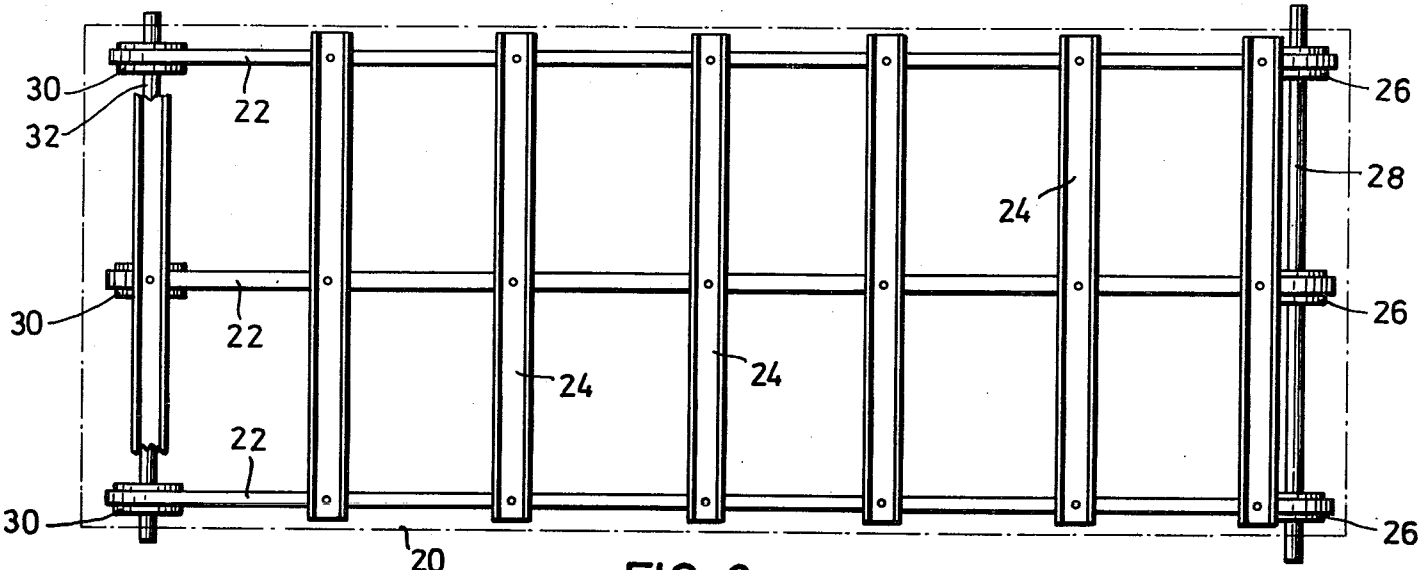
FIG. 3 is a fragmentary plan view of the floor of the refuse container.
Figure 4:
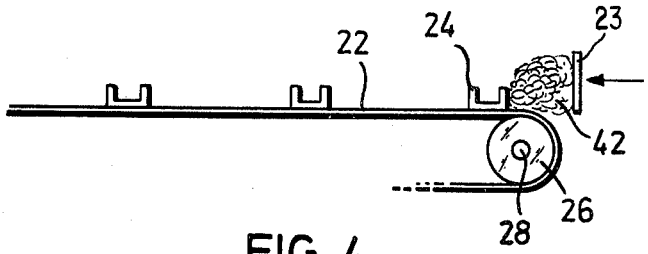
FIGS. 4–7 are diagrammatic illustrations of successive stages of the refuse compacting operation.
Figure 5:
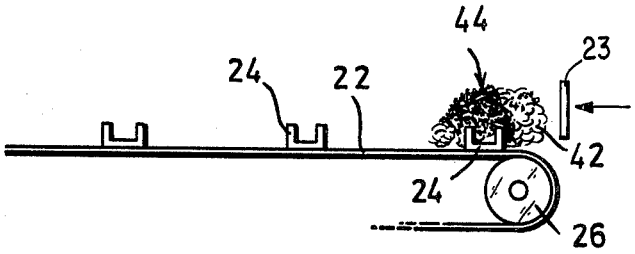
Figure 6:
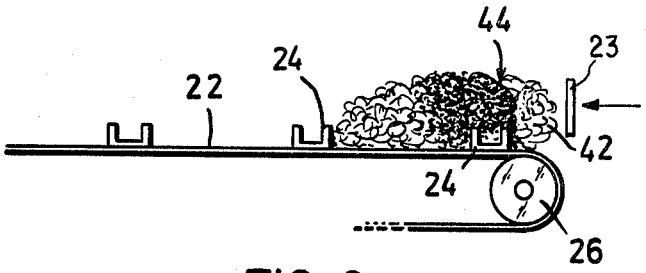
Figure 7:
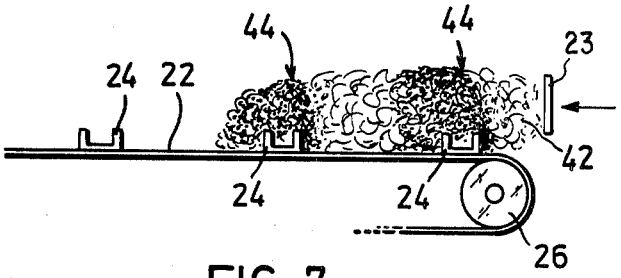

Referring now to FIGS. 1–3, a preferred embodiment of the refuse collection wagon will be described. Mounted on a chassis 12 is a refuse container 14 having a tail section 16 with a refuse filling opening 18. Extending transversely across the floor 20 of the container 14 are a plurality of bars 24 of substantially channelled section. The bars 24 are connected at uniformly spaced intervals to endless chains or cables 22, the chains or cables passing around guide rollers 26 and 30 at the rear and front ends, respectively, of the container and extending in a return run below the container floor 20 and transverse floor supports 21. As will be readily apparent, the floor 20 has openings (not shown) adjacent the guide rollers 26 and 30 permitting the chains and bars to pass therethrough. A cover apron 34 is provided adjacent the front opening to prevent refuse from sliding through this opening. The guide rollers 26 and 30 are mounted on shafts 28 and 32, respectively, the shaft 28 being driven by means of a hydraulic cylinder 36 and one way clutch 38. While a hydraulic cylinder and clutch arrangement are illustrated, other suitable drive means for the bars 24 and chains 22 may be substituted. For example, one of the shafts 28 or 32 may be driven by a power take-off shaft from the vehicle transmission. In any event, the drive arrangement permits rearward movement of the bars along the container floor 20 while preventing forward movement thereof.

The tail section 16 of the container 14 houses a pusher mechanism mounted so as to push refuse forwardly along the floor 20. Preferably, the pusher mechanism is of the type disclosed in German Pat. No. 2,519,931, issued May 26, 1977, the disclosure of which is hereby expressly incorporated by reference. Alternatively, the mechanism may consist of a pusher plate 23 connected to a hydraulic cylinder 25. The lower wall 27 of the refuse opening 18 extends inwardly to a point such that refuse introduced through the opening 18 falls onto the container floor rearwardly of the rearmost one of the bars 24 and forwardly of the pusher plate 23.

The manner in which refuse is compacted in the container is depicted in FIG. 4–7. As was discussed above, the bars 24 are held stationary throughout the compacting process, the bars serving as stops against which refuse is pushed forwardly and compacted. The uncompacted refuse 42 introduced through the opening 18 falls to the container floor 20 immediately rearwardly of the rearmost one of the bars 24 at which time the pusher cylinder 25 is actuated causing the refuse 42 to be compacted against this bar 24. As additional refuse is introduced into the container and compacting continued, a mass of compacted refuse 44 will accumulate behind the rearmost bar. When a sufficient mass of compacted refuse has accumulated, it will fall or tilt forwardly over the rearmost bar. As the process continues, previously compacted refuse is continually being pushed forward by the newly introduced and compacted refuse at the rear of the container. Each of the more forward bars serves as an additional stop so that in the event uncompacted refuse is carried forward when a compacted mass passes over a more rearwardly bar, additional compacting will occur. When compacted refuse reaches the forward wall of the container, it begins forming a pile sloping downwardly and rearwardly. Since all of the refuse is introduced at the rear end of the container floor and is initially compacted against the rearmost bar, no uncompacted refuse is present in the upper portion of the container. Also, since the primary compacting occurs between the rearmost bar and the pusher mechanism, the push mechanism needs have only a short operating stroke.

Figure 8:
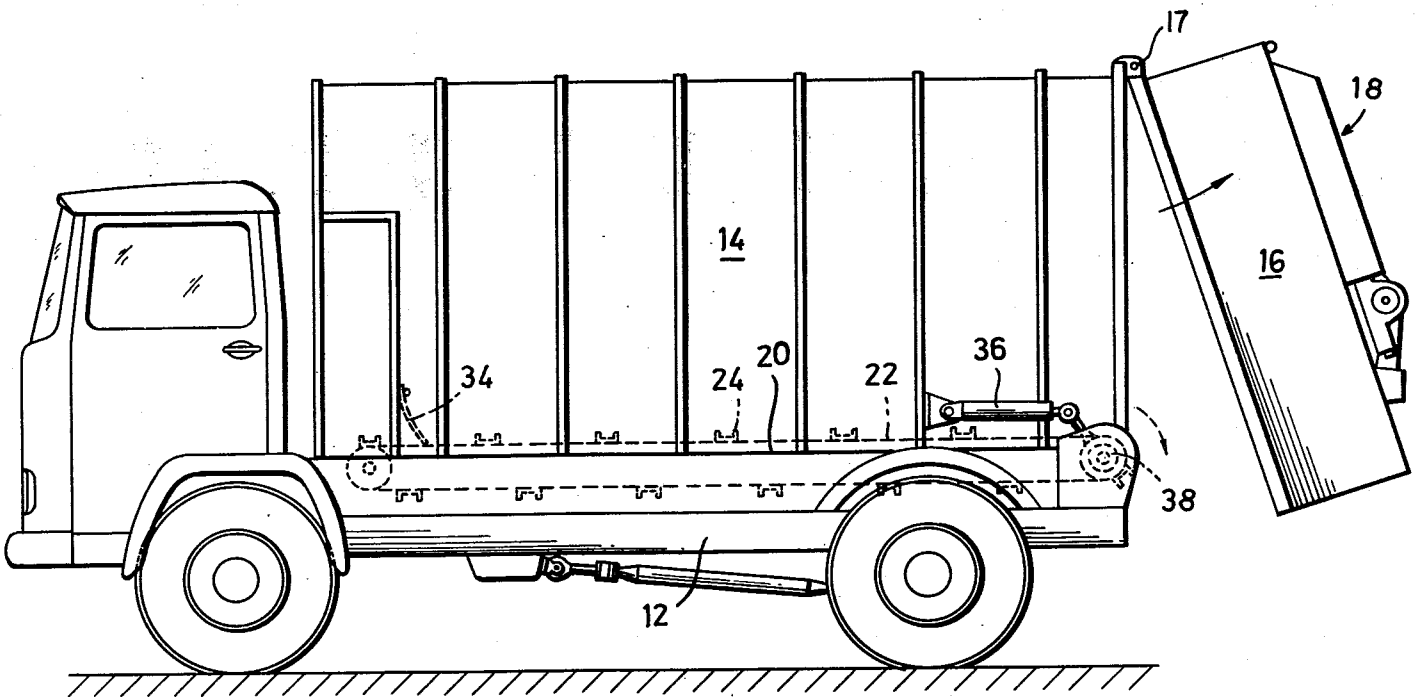
FIG. 8 is a side elevational view similar to that of FIG. 1 but illustrating the wagon in its unloading position.

As is shown in FIG. 8, the tail section 16 is connected at its upper end to the container 14 by hinge means 17. It will be understood that latch means (not shown) are provided to secure the lower portion of the tail section 16. When the container is to be unloaded, the tail section 16 is swung upwardly to the position shown in FIG. 8 and the drive means 36 actuated moving the bars 24 rearwardly. In the unloading operation, the bars 24 function as a conveyor to move the compacted refuse to the open rear of the container 14.

What is claimed is:

1. In a refuse collecting wagon having a chassis, a refuse container supported on the chassis and having a bottom wall and an opening for introducing refuse onto said bottom wall at the rear of said container, and compacting means operative to push refuse forwardly along said container bottom wall from the rear thereof, the improvement comprising:

a plurality of bars extending transversely across and projecting above said bottom wall in longitudinally spaced relationship to one another, the rearmost of said bars constituting a first stop against which refuse pushed forwardly by said compacting means is compacted successively forwardly located bars constituting additional stops against which refuse falling forwardly over the rearwardly located bars subsequent to being compacted thereat is again compacted;

means connecting said bars to one another for movement in unison; and one way drive means for moving said bars rearwardly, said drive means preventing forward movement of said bars.

2. The improvement according to claim 1 wherein said means connecting said bars comprises a pair of endless chains connected, respectively, to opposite ends of said bars, and guide rollers for said chains adjacent the front and rear ends of said container, said container having openings adjacent the front and rear ends thereof through which said chains and bars pass, whereby said chains and said bars attached thereto have a return run below said container bottom wall.

3. The improvement according to claim 2 wherein said drive means comprises hydraulic piston and cylinder means.

4. The improvement according to claim 3 wherein said bars are of U-shaped cross-section.

5. A refuse compacting mechanism for a refuse container having an opening for the introduction of refuse into the container floor adjacent one end thereof, said compacting mechanism comprising:

a plurality of bars extending across and projecting above said container floor in longitudinally spaced relation to one another and parallel to said one end of said floor; and a pusher mechanism located at said one end and having a pusher plate parallel to said bars and moveable along said container floor toward and away from the rearmost of said bars, the rearmost of said bars constituting a first stop against which refuse pushed forwardly by said compacting means is compacted, successively forwardly located bars constituting additional stops against which refuse falling forwardly over the rearwardly located bars subsequent to being compacted thereat is again compacted.

6. The refuse compacting mechanism of claim 5 wherein said container has a normally closed discharge opening adjacent said one end of said floor and said compacting mechanism further includes means connecting said bars to one another for movement in unison along said container floor and drive means for moving said bars toward said discharge opening.

7. The refuse compacting mechanism of claim 6 wherein said means connecting said bars comprise endless chains having upper runs extending the length of said container floor and lower runs extending below said container floor.

8. The refuse compacting mechanism of claim 6 wherein said container is mounted on a vehicle chassis, said opening for the introduction of refuse being located in the rear wall of said container and said rear wall is moveable relative to said container to provide said discharge opening.

* * * * *

UNITED STATES PATENT OFFICE

CERTIFICATE OF CORRECTION

PATENT NO. : 4,149,642

DATED : April 17, 1979

INVENTOR(S) : WILLI SCHNEIDER

It is certified that error appears in the above-identified patent and that said Letters Patent are hereby corrected as shown below:

On the cover sheet add:

--[30] Foreign Application Priority Data

February 12, 1975 Germany 2505866 --.

Column 4, line 55, "compacted successively" should read

--compacted, successively--

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*